United States Patent [19]

Fujiwara et al.

[11] 4,324,112

[45] Apr. 13, 1982

[54] REFRIGERATION SYSTEM

[75] Inventors: Kenichi Fujiwara, Kariya; Hikaru Sugi, Nagoya; Mineo Nishikawa, Kariya, all of Japan

[73] Assignee: Nippondenso Co., Ltd., Kariya, Japan

[21] Appl. No.: 147,501

[22] Filed: May 7, 1980

[30] Foreign Application Priority Data

| | | | |
|---|---|---|---|
| May 10, 1979 | [JP] | Japan | 54/57526 |
| Jun. 29, 1979 | [JP] | Japan | 54/83357 |
| Aug. 22, 1979 | [JP] | Japan | 54/106835 |
| Jan. 25, 1980 | [JP] | Japan | 55/7555 |

[51] Int. Cl.[3] ..... F25B 41/06

[52] U.S. Cl. ..... 62/511; 62/527; 138/40; 138/44

[58] Field of Search ..... 62/504, 511, 527; 138/40, 44

[56] References Cited

U.S. PATENT DOCUMENTS

| | | | |
|---|---|---|---|
| 1,879,197 | 9/1932 | Greenwald | 62/511 |
| 2,393,854 | 1/1946 | Carpenter | 62/511 |
| 2,645,099 | 7/1953 | Cumming | 62/511 |
| 2,676,470 | 4/1954 | Streitz | 62/511 |
| 2,694,296 | 11/1954 | Prosek et al. | 62/511 |
| 2,791,104 | 5/1957 | Duz | 62/527 |
| 3,006,164 | 10/1961 | McMillan | 62/511 |

*Primary Examiner*—Ronald C. Capossela

*Attorney, Agent, or Firm*—Cushman, Darby & Cushman

[57] ABSTRACT

A refrigeration system for use in air conditioner for automobiles. The refrigeration system has a pressure reducing device disposed between a condenser and an evaporator and adapted for permitting the refrigerant to make an adiabatic expansion therethrough. The pressure reducing device includes a flow restricting and resisting means such as an orifice and a flow resisting means disposed at the upstream side of the flow restricting and resisting means. The flow resisting means are adapted to impart a resistance to the flow of refrigerant and may be constituted by a capillary tube or a constant-pressure-differential valve. Because of the resistance imparted by the flow resisting means, the dryness factor of the refrigerant at the inlet to the flow restricting and resisting means is maintained between 0 and 0.1, so that the flow rate of the refrigerant is largely affected by the characteristic of the flow restricting and resisting means. Consequently, it is possible to vary the flow rate of the refrigerant over a wide range while maintaining the degree of subcooling of the refrigerant, i.e. at the inlet side of the flow resisting means, at a suitable level for an efficient operation of the refrigeration cycle.

7 Claims, 18 Drawing Figures

REFRIGERATION SYSTEM

BACKGROUND OF THE INVENTION

The present invention relates to a refrigeration system and, more particularly, to a refrigeration system suitable for use in air conditioner of automobiles, having a fixed, pressure reducing device.

Hitherto, in the refrigeration system of the kind described, a capillary tube which interconnects the condenser and the evaporator of the refrigeration system plays also the role of the pressure reducing device. As the required flow rate of refrigerant is determined by the thermal load of the refrigeration cycle, the state of the refrigerant at the capillary tube inlet, such as degree of subcooling or dryness factor, is automatically determined by the flow-rate characteristic of the capillary tube. More specifically, if the flow rate of the refrigerant by weight is insufficient for the thermal load, the refrigerant is superheated as it flows through the evaporator toward the outlet of the latter, so that the liquid refrigerant in the accumulator is evaporated and moved into the condenser to enlarge the subcooling region in the condenser, resulting in an increased degree of subcooling of the refrigerant at the condenser outlet. Consequently, the flow rate of the refrigerant is increased to automatically achieve the balance of the cycle.

To the contrary, as the thermal load is decreased, the refrigerant at the evaporator outlet is partially liquefied and the refrigerant is stored in the accumulator. As a result, the subcooling region at the condenser outlet is reduced resulting in a smaller degree of subcooling at the refrigerant. As the thermal load is further reduced, the refrigerant comes to have a dryness factor x so that the flow rate of refrigerant is reduced to achieve the balance of the cycle.

As to this balance of the refrigeration cycle, it is well known that the refrigerant preferably is subcooled to some extent before it leaves the condenser, in order to obtain a large difference of enthalpy between the inlet and outlet of the evaporator. In the refrigeration system for air conditioners of automobiles, the fluctuation of thermal load is so large that the flow rate of the refrigerant changes widely. Namely, the refrigerant flows at an extremely large flow rate during heavy load operation, resulting in an extremely large degree of subcooling. This in turn requires a higher rate of discharge of heat from the refrigerant in the condenser and, hence, an extraordinarily high pressure of the outlet side of compressor, possible resulting in a discharge of refrigerant through a safety valve or reduction of performance due to the elevated pressure at the high pressure side of the refrigeration cycle.

Under these circumstances, there is an increasing demand for fixed flow restriction member having a flow rate characteristic which suits for large fluctuation of the flow rate and small rate of change of degree of subcooling.

SUMMARY OF THE INVENTION

The present invention has been achieved in compliance with the above-described demand. Among the flow restriction members, the flow restricting and resisting member i.e. a throttle member involving a drastic change of shape or cross-sectional area, e.g. an orifice, can cause a large change of flow rate in the dry state of the refrigerant. The present inventors, upon recognition of this characteristic of the fixed flow restriction member, considered that a large change of flow rate will be obtained even with a small change of degree of subcooling also in the subcooling region, by applying such flow restricting and resisting member to the subcooling region.

It is, therefore, a major object of the invention to provide a refrigeration system having an additional resisting means at the upstream side of a flow restricting and resisting means to make it possible to obtain a certain dryness factor of the refrigerant at the inlet side of the downstream side flow restricting and resisting means, thereby to obtain a large change of flow rate of refrigerant even by a slight change of degree of subcooling of the refrigerant at the condenser outlet.

It is another object of the invention to provide a refrigeration system in which the above-mentioned flow restricting and resisting means can be mounted quite easily by making use of "0" ring joints of the refrigerant pipe.

It is still another object of the invention to provide a refrigeration system in which the magnitude of the restriction or resistance in the downstream-side flow restricting and resisting means can be varied by changing the refrigerant pressure at the upstream side, i.e. at the same side as the evaporator and the refrigerant pressure at the downstream side, i.e. at the same side as the evaporator, so that the change of flow rate caused by the change of degree of subcooling is enhanced.

It is a further object of the invention to provide a refrigeration system in which the ratio l/d between the minimum diameter d of the flow restricting and resisting means to the length l of the region of the minimum diameter of the same is selected to fall within a region between 0.8 and 3.0, so that the change of the refrigerant flow rate due to the change of degree of subcooling is further enhanced.

To these ends, according to the invention, there is provided a refrigeration system comprising a condenser, an evaporator and a pressure reducing means connected between the condenser and the evaporator, the pressure reducing means including a flow restricting and resisting means and flow resisting means which imparts a resistance to the flow of refrigerant, said flow resisting means being disposed at the upstream side of said flow restricting and resisting means.

These and other objects, as well as advantageous features of the invention will become more clear from the following description of the preferred embodiments taken in conjunction with the accompanying drawings.

DESCRIPTION OF THE PREFERRED EMBODIMENTS

Before turning to the description of the preferred embodiments, an explanation will be made hereinunder as to the conventional refrigeration system, in order to clarify the drawbacks of the conventional system and, hence, the technical object to be achieved by the present invention.

Figure 1:
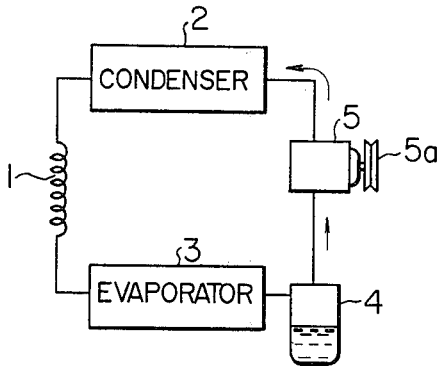
FIG. 1 is a diagram showing the refrigeration cycle of a conventional refrigeration system.
Figure 2:
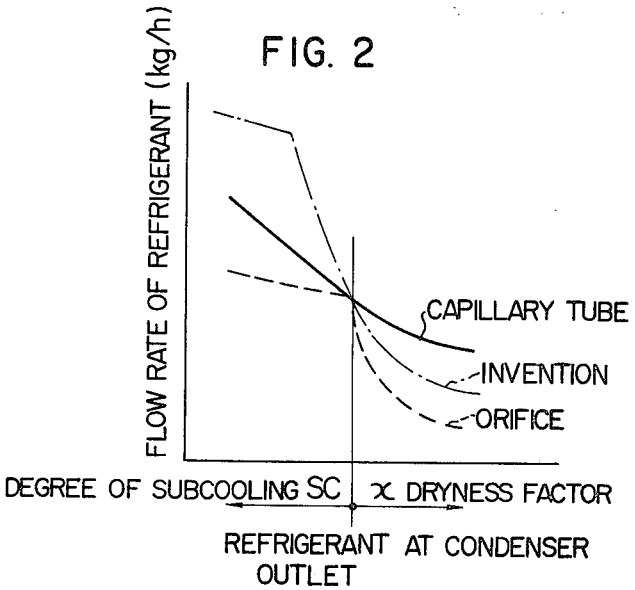
FIG. 2 shows the flow-rate characteristic of a fixed flow restriction member, for the purpose of explanation of the conventional refrigeration system and a refrigeration system of the invention.
Figure 3:
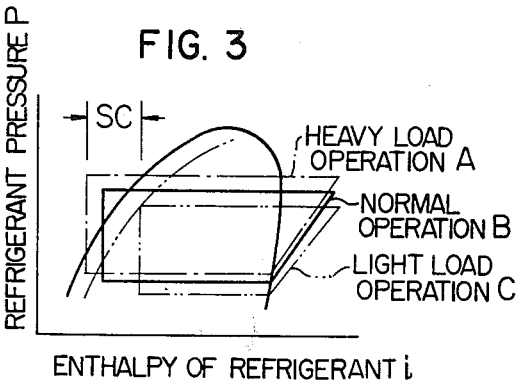
FIG. 3 is a Mollier chart for explaining the operation of a conventional refrigeration system.

Referring first to FIG. 1, there has been proposed a refrigeration system in which a capillary tube 1 interconnecting the condenser 2 and the evaporator 3 of the system plays also the role of an expansion or pressure reducing device. The operation of this capillary tube 1 is as follows. If the required flow rate of refrigerant is determined to some extent by the thermal load imposed upon the refrigeration cycle, the state of refrigerant such as degree of subcooling or dryness factor is determined to some extent at the inlet side of the capillary tube 1, so as to permit the refrigerant to flow at the above-mentioned required flow rate, in accordance with the flow-rate characteristic as shown in FIG. 2. More specifically, if the flow rate by weight of the refrigerant is insufficient for the thermal load, the refrigerant at the condenser outlet is heated to a certain degree of superheating, so that the liquid refrigerant in an accumulator 4 is evaporated and moved into the condenser 2 to enlarge the area of the subcooling region in the latter, resulting in an increased degree of subcooling SC at the outlet side of the condenser 2 as shown by cycle diagram A of FIG. 3. In consequence, the flow rate of refrigerant is increased in accordance with the characteristic shown in FIG. 2, thereby to obtain a balanced state of the refrigeration cycle.

To the contrary, as the thermal load is decreased, the refrigerant at the outlet side of the evaporator 3 is partly liquefied and stored in the accumulator 4, so that the subcooling region in the outlet side of the evaporator 2 is decreased to reduce the degree of subcooling SC at the condenser outlet. As the thermal load is further decreased, the cycle is shifted to that shown by a diagram C of FIG. 3 involving a dryness factor x. In consequence, the flow rate of refrigerant is reduced to achieve a balanced state of the cycle.

It is well known that, in order to obtain a large difference of enthalpy between the inlet and outlet of the condenser, it is preferred that the refrigerant at the condenser outlet has a certain degree of subcooling.

In the refrigeration system for air conditioners of automobiles subjected to a large fluctuation of thermal load, the fluctuation of flow rate of refrigerant is correspondingly large. Therefore, even if the system is adjusted to provide a degree of subcooling SC of 5° C. in the normal operation shown by diagram B of FIG. 3, an extraordinarily large degree of subcooling is caused as shown by diagram A in FIG. 3 during heavy load operation. Consequently, the required amount of heat discharge in the condenser 2 is increased to cause an extraordinarily high pressure at the discharge side of the compressor, resulting in unfavourable states such as relief or discharge of the refrigerant from a safety valve, reduction of performance due to the elevated pressure at the high-pressure side of the cycle and so forth. This has given a rise to a demand for a fixed flow restriction device capable of effecting a large change of flow rate with a small fluctuation of degree of subcooling. This demand is fairly fulfilled by the present invention, as will be understood from the following description of the preferred embodiments of the invention.

Figure 4:
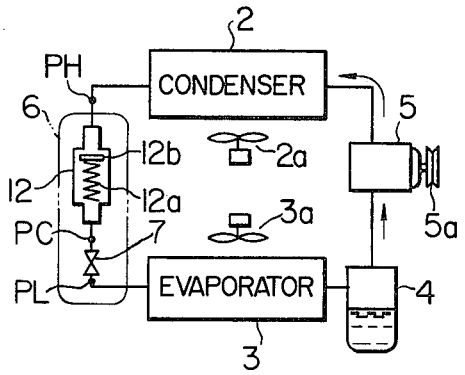
FIG. 4 is a diagram showin a refrigeration system constructed in accordance with an embodiment of the invention.

Referring to FIG. 4, a condenser 2 is connected to the downstream side of a compressor 5 which is adapted to be an automobile engine (not shown) through an electromagnetic clutch 5*a*. The condenser 2 is disposed in the engine room at a place near a radiator so as to be effectively cooled by a cooling air forcibly supplied by a cooling fan 2*a*. An evaporator disposed under the instrument panel of the cabin or the like place is for cooling the internal air or external air supplied by a fan 3*a*. The arrangement is such that the air cooled through a heat exchange with the evaporator is blown into the cabin through an air outlet (not shown).

A constant differential pressure valve 12 is disposed at the upstream side of an orifice 7. The constant differential pressure valve 12 and the orifice 7 in combination constitute a pressure reducing device 6. The constant differential pressure valve 12 has a valve member 12*b* and a spring 12*a* which is so set as to permit the valve member 12*b* to open as the pressure differential across the valve member 12*b* reaches a predetermined level, e.g. 2 to 3.5 Kg/cm$^2$.

A symbol $P_H$ represents the refrigerant pressure at the outlet from the condenser 2, i.e. at the inlet to the constant differential pressure valve 12, and is set at, for example, 15 Kg/cm$^2$. The refrigerant pressure at the outlet side of the orifice 7 is represented by $P_L$, while $P_C$ represents the intermediate pressure at an intermediate point between the constant differential pressure valve 12 and the orifice 7. For example, the pressure $P_C$ is set at 11.5 Kg/cm$^2$($15-3.5=11.5$).

Figure 5:
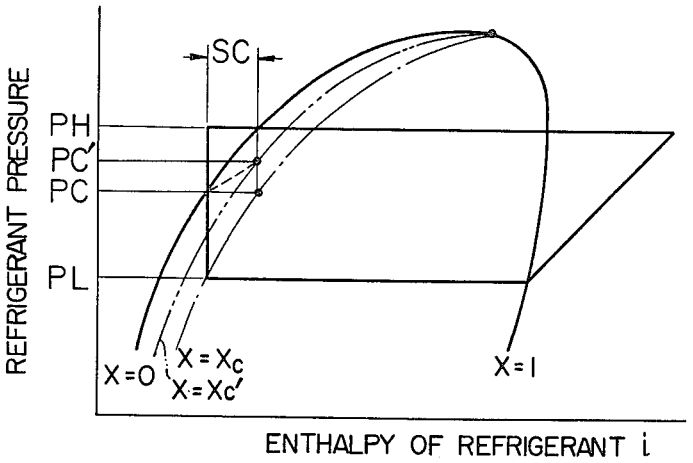
FIG. 5 is a Mollier chart for explaining the operation of a refrigeration system in accordance with the invention.

In the Mollier chart shown in FIG. 5, supposing here that the degree of subcooling of the refrigerant at the inlet of the valve 12 is 12° C., the dryness factor x of the refrigerant at the intermediate pressure $P_C$ is zero. The dryness factor x at the pressure $P_C$ is gradually increased as the degree of subcooling is reduced. If the degree of subcooling is zero, the dryness factor x takes a value $x_c$ ($=0.1$). As the dryness factor of the refrigerant at the inlet of the orifice varies within the range of between 0 and 0.1, the flow rate of the refrigerant is largely changed in accordance with the characteristic of the orifice 7.

Figure 10:
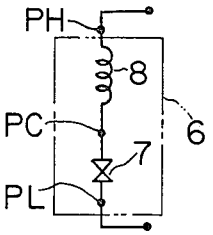
FIGS. 10, 11 and 12 are cycle charts drawn for different examples of the pressure reducing device.

FIG. 10 shows another embodiment in which a fixed restriction such as a capillary tube 8 is used in place of the aforementioned constant differential pressure valve 12. A capillary tube 8, which provides a refrigerant pressure of 11.5 Kg/cm$^2$ at its outlet with a degree of subcooling of 12° C. at the inlet thereof, i.e. a capillary tube which causes a pressure drop of $15-11.5=3.5$ (Kg/cm$^2$), provides a small degree of subcooling at the condenser outlet. If the degree of subcooling falls to 0°

C., a pressure $P_C'$, which is somewhat higher than that $P_C$ obtained with the use of the constant differential pressure valve 12, is obtained at the outlet of the capillary tube, as will be seen from FIG. 6. This is attributable to the following reason. Namely, the flow rate characteristic inherent in capillary tube, in which the resistance is increased as the degree of subcooling becomes small as shown in FIG. 2, is exceeded or overcome by the reduction of the refrigerant flow rate due to the dryness factor of the refrigerant at the inlet side of the orifice, so that the higher pressure $P_C'$ is obtained as stated above.

In consequence, in the embodiment shown in FIG. 10, the change of dryness factor at the inlet of the orifice is somewhat reduced as will be seen from comparison between $X_C$ and $X'_C$. In this embodiment, the flow rate is changed to cause a change of dryness factor between O and $X'_C$ when the degree of subcooling is changed from 12° C. to 0° C. Thus, in this case, the change of flow rate of refrigerant is somewhat smaller than that obtained with the use of the constant differential pressure valve 12. This change of flow rate, however, is much greater than that obtained when the capillary tube is used solely, i.e. without being combined with the orifice.

As will be apparent from the foregoing description, the flow-rate characteristic of the refrigerant is largely affected by the flow-rate characteristic of the orifice 7 as a single member. The present inventors, therefore, have studied minutely the relationship between the shape of the orifice 7 as a single body and the flow-rate characteristic of the same.

FIGS. 6*a*, 6*b*, 6*c* and 6*d* show in section four orifices of different forms.

Figure 6A:
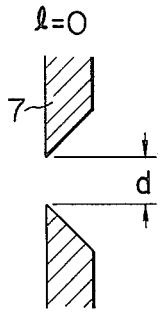
FIGS. 6*a*, 6*b*, 6*c* and 6*d* are cross-sectional views of orifices having different shapes.
Figure 6B:
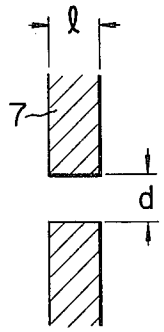
Figure 6C:
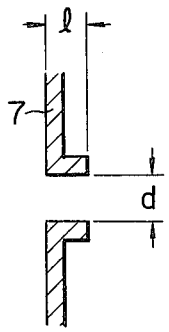
Figure 6D:
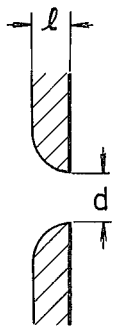

More specifically, FIG. 6*a* shows a so-called thin-blade type orifice which is generally considered as being an ideal form of orifice, having the axial length l almost equal to zero at the portion of the minimum diameter d. In contrast to the above, orifices 7 shown in FIGS. 6*b* and 6*c* have substantial lengths l at portions of the minimum diameter d. The orifice shown in FIG. 6*d* is a nozzle.

Figure 7:
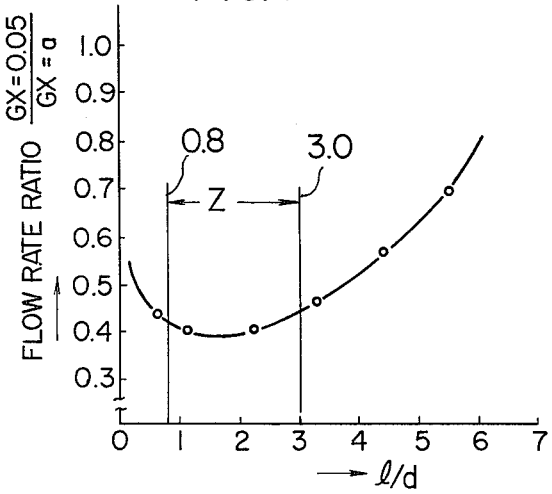
FIGS. 7 and 8 are graphs showing the results of experiments conducted with the refrigeration system of the invention.

FIG. 7 shows the result of tests conducted seeking for the rate of change of refrigerant flow rate by varying ratio of the length l to the minimum diameter d (l/d). More specifically, in FIG. 7, the axis of abscissa shows the above-mentioned ratio l/d, whereas the axis of ordinate represents the ratio of flow rate Gx=0.05/Gx=0 between the flow rate Gx=0 obtained when the dryness factor x at the condenser outlet is zero and the flow rate Gx=0.05 obtained when the dryness factor x at the condenser outlet is 0.05. Thus, the larger value of the flow rate ratio Gx=0.05/Gx=0 means the larger rate of change of the flow rate of refrigerant.

As will be understood from the test results shown in FIG. 7, the flow rate ratio Gx=0.05/Gx=0 takes the minimum value which is about 0.4 at a point near l/d=1.5. It will be also seen that the flow rate ratio Gx=0.05/Gx=0 is maintained at a value approximating the minimum value, in the region Z of the ratio l/d between 0.8 and 3.0.

According to the invention, therefore, the ratio l/d between the minimum diameter d and the length l of the region of minimum diameter d is selected to fall within the region between 0.8 and 3.0 to obtain the maximum rate of change of flow rate.

Figure 8:
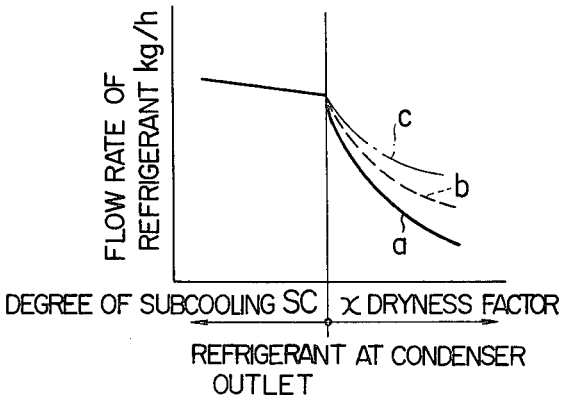

In FIG. 8, the degree of subcooling SC at the condenser outlet, as well as the dryness factor x, whereas the axis of ordinate represents the flow rate of refrigerant (Kg/h). The curves a, b and c show, respectively, the characteristics obtained with orifices having the ratios l/d of 0.8 to 3.0, 0.5 and 4.0.

From the comparison of these curves a, b and c, it will be understood that the range of the ratio as specified by the present invention provides the greatest change of degree of refrigerant flow rate.

Figure 9:
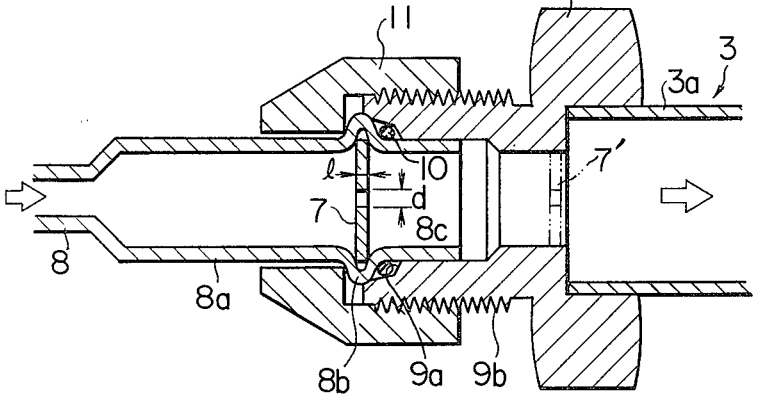
FIG. 9 is a cross-sectional view of a pressure reducing device in accordance with an embodiment of the invention.

Referring now to FIG. 9 showing a preferred form of the orifice 7, the outlet end portion 8*a* of the capillary tube 8 is expanded to have a large diameter. At an intermediate portion of the capillary tube 8, an "0" ring joint 8*b* is formed unitarily to expand therefrom by a bulge work. The orifice 7 is fixed to and held by the inner periphery of the "0" ring joint 8*b*. The capillary tube 8 is constituted by, for example, a copper tube. After the expansion of the outlet end portion 8*a* and a subsequent loose fitting of a nut 11, the portion of the capillary tube 8 is further expanded at a portion 8*c* thereof between the position of the "0" ring joint 8*b* and the outlet portion 8*c*. Thereafter, the orifice 7 is inserted and a drawing is effected on the portion 8*c* to form the "0" ring joint 9*b* and, simultaneously, to fix the orifice 7 to the inner periphery of the "0" ring joint 8*b*. The orifice 7 is formed by making a small aperture in the center of a metallic disc such as of brass.

To the inlet pipe 3*a* (made of, for example, aluminum) to the evaporator 3, attached by soldering is a half union 9 made of aluminum. An "0⇄ ring 10 is fitted to the "0" ring joint 8*b* of the capillary tube 8, and the outlet portion 8*c* of the capillary tube 8 is inserted into the half union 9, such that the "0" ring is received by a recess 9*a* formed at the center of the half union 9. Subsequently, a nut 11 of brass or aluminum is fastened to a threaded portion 9*b* of the half union thereby to couple the outlet portion 8*a* of the capillary tube 8 to the half union 9 and, at the same time, to compress and deform the "0" ring 10 so as to form a secure seal at the coupling portion. The orifice 7 may be formed unitarily with the half union 9 as represented by two-dots-and-dash line 7' in FIG. 9 by effecting a mechanical cutting on the inner peripheral surface of the half union 9.

Figure 11:
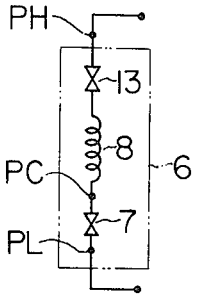
Figure 12:
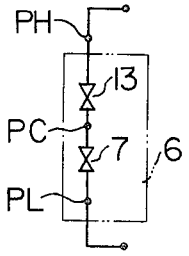

FIGS. 11 and 12 show different embodiments of the invention. Referring first to FIG. 11, a capillary tube 8 and an orifice 13 connected in series to each other are disposed at the upstream side of the orifice 7 so as to act as the flow resisting means. In the embodiment shown in FIG. 12, an orifice 13 is disposed at the upstream side of the orifice 7 as the flow resisting means.

Thus, the flow resisting means at the upstream side of the orifice 7 can have various forms. In each case, the flow rate of refrigerant is widely changed by imparting a certain dryness to the refrigerant at the inlet to the orifice 7.

The flow rate characteristic as shown in FIG. 2 can be commonly achieved by various forms of flow restricting and resisting means having a drastic change of shape, such as orifice, nozzle, venturi and so forth. According to the invention, the pressure reducing device 6 includes, in addition to the flow restricting and resisting means having the drastic change of shape such as orifice, nozzle, venturi or the like, a flow resisting means 8, 11 disposed at the upstream side of the flow restricting and resisting means, so that the refrigerant flowing into the flow restricting and resisting means can have a certain dryness. It is therefore possible to obtain a large change of flow rate of the refrigerant with small fluctuation of degree of subcooling at the condenser outlet.

This feature is quite advantageous particularly in the use for the refrigerator of an air conditioner for automobiles which is inevitably subjected to a wide fluctuation of the thermal load, because the refrigeration system of the invention can maintain the degree of subcooling at an adequate level even when the thermal load is changed largely. The change of flow rate of refrigerant caused by the orifice 7 is maximized particularly when the ratio l/d between the length l of the region of the minimum diameter and the value of the minimum diameter d of the orifice 7 is selected to fall within the region of 0.8 and 3.0, so that the above-described advantage of the invention can be enhanced.

Figure 13:
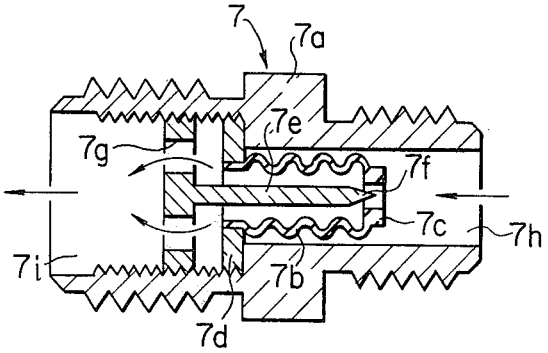
FIG. 13 is a sectional view of an example of a variable flow restricting and resisting member.

FIG. 13 shows an example of the variable orifice 7 constituting the flow restricting and resisting means.

This variable orifice 7 is composed of a casing *7a*, a bellows *7b* made of a highly resilient metal such as phosphor bronze, and a needle *7e*. The casing *7a* has an inlet *7h* and an outlet *7i* for the refrigerant. The portion of the refrigerant passage near the outlet is threaded internally. The end portions of the casing *7a* are externally threaded for screwing engagement with associated refrigerant pipes and the outer extremities are tapered. The aforementioned bellows *7b* is fixed at its one end to a bellows holding member *7d* which in turn is screwed to and retained by the internal threaded port on of the outlet portion of the casing *7a*, whereas the other end of the bellows *7b* forms a flow restricting and resisting section *7c* having a drastic change of shape such as an orifice or a nozzle. The cross-sectional area of the flow restricting and resistance can be varied by the position thereof in relation to the end *7f* of the needle *7e*. As in the case of the bellows holding member *7d*, the needle *7e* is screwed to the female screw of the outlet portion of the casing *7a*, and is positioned closer to the outlet end than the bellows holding member *7d* is. The needle portion of the needle *7e* is projected into the bellows *7b*. Further, since the needle *7e* is engaged by the female screw of the outlet portion of the casing *7a*, the position thereof can be freely adjusted as desired. The needle *7e* is further provided with a bore *7g* which permits the refrigerant to flow from the inlet portion *7h* to the outlet portion *7i*.

The gaseous refrigerant of a high temperature and pressure discharged from the compressor 5 is cooled and liquefied in the condenser 2 and the pressure thereof is reduced as it flows through the pressure reducing device 6, i.e. the capillary tube 8 and the variable flow restricting and resisting means 7 including the inlet section *7h*, orifice section, i.e. the restricting and resisting section *7c*, bore *7g* of the needle and the outlet section *7i*, thereby to make an adiabatic expansion. In consequence, the refrigerant in the form of admixture of atomized liquid particle and the gaseous phase flows into the evaporator 3 to be evaporated in the latter. The gaseous refrigerant is then sucked by the compressor 5 through the accumulator 4 for a repeated cyclic operation.

In the foregoing description of operation made in conjunction with FIG. 5, an assumption was made that the pressure of the refrigerant at the inlet of the capillary tube 8 is maintained at a constant level of pH=15 Kg/cm$^2$. The condensation pressure pH, however, is often increased to a level as high as 20 to 25 Kg/cm$^2$, due to a reduction of the heat radiating capacity of the condenser as in the case of traffic congestion in the summer season. In such an occasion, the pressure of the refrigerant at the inlet section *7h* of the variable restricting resistance 7 is increased correspondingly. In consequence, the pressure differential of the refrigerant between the outlet section *7i*, i.e. the evaporation section and the inlet section is increased to cause a deflation of the bellows *7b* which in turn moves the orifice section *7c* to the downstream side thereby to reduce the area of the passage formed between the end *7f* of the needle and the orifice section *7c*. In consequence, the resistance against the flowing refrigerant produced by the pressure reducing device is decreased.

To the contrary if the condensation pressure pH is lowered the pressure differential of the refrigerant between the inlet section *7h* and the outlet section *7i* of the flow restricting and resisting device is reduced to permit the bellows *7b* to inflate, so that the area of the flowing passage is increased to reduce the resistance against the flow of refrigerant.

Figure 14:
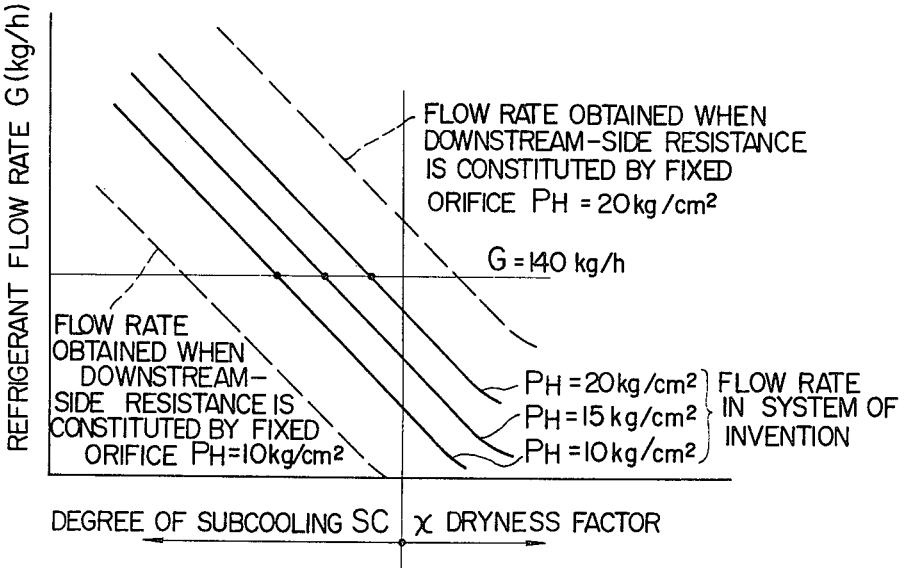
FIG. 14 shows the flow-rate characteristic of the pressure reducing device.

Therefore, the pressure reducing device 6 of the refrigeration system of the invention exhibits a characteristic as shown by full-line curves shown in FIG. 14. It will be understood that the influence of the condensation pressure pH is reduced as compared with the characteristic shown by broken-line curves in FIG. 14 obtained when a fixed flow restricting and resisting member of fixed area such as an orifice or a nozzle is used as the downstream side resistance of the pressure reducing device 6.

Assuming here that the flow rate of the refrigerant G is 140 Kg/h the degree of subcooling SC and dryness factor x are largely varied by a small fluctuation of the condensation pressure pH, whereas, according to the invention, the degree of subcooling is maintained sufficiently small for a given change of the condensation pressure pH. Thus, according to the invention, it is possible to maintain the degree of subcooling at an adequate level relatively easily.

The construction of the variable flow restricting and resistance means 7 as shown in FIG. 13 is not exclusive and the construction can have a large variety. For instance, if the inlet and outlet sections *7h* and *7i* in FIG. 13 are reversed, the dependency of flow rate characteristic on the condensation pressure is also reversed.

Figure 15:
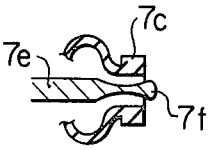
FIG. 15 is a cross-sectional view of another example of end structure of a needle constituting the downstream-side variable flow restricting and resisting member of the pressure reducing device.

FIG. 15 shows a modification of construction of the end portion of the needle *7f* shown in FIG. 13. By adopting such a modification, the influence of the flowrate characteristic on the condensation pressure pH and evaporation pressure PL can be varied as desired. The shape of the end of the needle *7f* can be selected to meet the purpose of use of the refrigeration system.

This embodiment permits, thanks to the fact that the magnitude of the flow restricting and resisting action caused by the downstream-side flow restricting and resisting means can be varied by changing the condensation pressure pH and the evaporation pressure PL, to produce such a flowrate characteristic of the pressure reducing device as creating a small change of degree of subcooling SC by the fluctuation of the condensation pressure pH and the evaporation pressure PL, thereby to further enhance the aforementioned advantage brought about by the present invention.

What is claimed is:

1. A refrigeration system comprising:

a refrigerant circuit which includes a condenser, an evaporator and a pressure reducing device interconnected between said condenser and said evaporator, said pressure reducing device including a flow restricting and resisting means and a flow resisting means disposed at the upstream side of said flow restricting and resisting means and adapted to impart a resistance to the refrigerant flowing therethrough, said flow restricting and resistance means comprising circular orifice means having an l/d ratio in the range of from about 0.8 to about 3.0, where l equals the length of the region of minimum diameter of said orifice means and d equals said minimum diameter.

2. A refrigeration system as claimed in claim 1 wherein the orifice means converges downstream.

3. A refrigeration system as claimed in claim 1, characterized in that said flow resisting means includes a constant-pressure-differential valve.

4. A refrigeration system as claimed in claim 1, characterized in that said flow resisting means includes a capillary tube.

5. A refrigeration system as claimed in claim 1, wherein said orifice means is fixed to the inner periphery of an "0" ring joint formed in a refrigerant pipe to unitarily project radially outwardly therefrom.

6. A refrigeration system as claimed in claim 1, wherein said flow resisting means includes a capillary tube having an "0" ring joint for fixing said orifice means unitarily at the outlet portion thereof.

7. A refrigeration system as claimed in claim 1, wherein said flow restricting and resisting means include means for varying the magnitude of resistance in accordance with the condensation pressure and the evaporation pressure.

* * * * *